US005111753A

United States Patent [19]

Zigler et al.

[11] Patent Number: 5,111,753

[45] Date of Patent: May 12, 1992

[54] LIGHT WEIGHT FATIGUE RESISTANT RAILCAR TRUCK BOLSTER

[75] Inventors: Herbert L. Zigler, Alliance, Ohio; Robert D. Wronkiewicz, Park Ridge, Ill.; Franklin McKeown, Jr., St. Louis, Mo.; William A. Wachter, Granite City, Ill.

[73] Assignee: Amsted Industries Incorporated, Chicago, Ill.

[21] Appl. No.: 631,905

[22] Filed: Dec. 21, 1990

[51] Int. Cl.[5] ..... B61F 5/04

[52] U.S. Cl. ..... 105/230

[58] Field of Search ..... 105/226, 230, 200, 202, 105/182.1, 157.1

[56] References Cited

U.S. PATENT DOCUMENTS

| | | | |
|---|---|---|---|
| 2,552,019 | 5/1951 | Stertzbach | 105/230 |
| 4,114,540 | 9/1978 | Strugielski et al. | 105/230 |
| 4,196,672 | 4/1980 | Bullock | 105/230 |
| 4,322,981 | 4/1982 | Radwill | 105/230 |
| 4,342,266 | 8/1982 | Cooley | 105/230 |
| 4,370,933 | 2/1983 | Mulcahy | 105/230 |
| 4,753,174 | 6/1988 | Berg et al. | 105/230 |
| 4,838,174 | 6/1989 | Moehling | 105/230 |

OTHER PUBLICATIONS

Car and Locomotive Cyclopedia, Simmons-Boardman Publishing Corp., 1974, pp. S13-54 and S13-55.

ASF User's Guide-Freight Car Truck Design, American Steel Foundries sales publication (at p. 3).

*Primary Examiner*—Robert J. Oberleitner
*Assistant Examiner*—Mark T. Le
*Attorney, Agent, or Firm*—Edward J. Brosius; F. S. Gregorczyk

[57] ABSTRACT

A light weight fatigue resistant cast steel bolster for a freight railcar truck without any opening in the bolster bottom wall having internal risers connected to the bottom wall at bend points and with a ratio of metal in the top and bottom walls that lessens the distance of the neutral axis above the bolster bottom wall as compared to comparable prior art bolsters.

5 Claims, 3 Drawing Sheets

LIGHT WEIGHT FATIGUE RESISTANT RAILCAR TRUCK BOLSTER

FIELD OF THE INVENTION

This invention relates to an improved railcar truck and more particularly to a lighter weight bolster for a three piece freight car truck.

BACKGROUND OF THE INVENTION

The more prevalent construction for freight railcars in the U.S.A. includes what are known as "three piece" trucks. Trucks are wheeled vehicles that ride on tracks and two such trucks are normally used beneath the car body, one truck at each end. The "three piece" terminology refers to two side frames, that are positioned to parallel the wheels and rails, and a single bolster that is transverse to and spans the distance between the side frames. Railcar trucks must be strong enough to support both the car structure and its contents, particularly the bolsters on which the carbody is directly supported and do so in a severe operating environment that magnifies the static loading by a factor of 3 or greater. Most usually the side frames and bolsters are manufactured of cast steel. Thus the trucks themselves contribute a substantial part of the total weight placed on the rails. The latter is regulated by the rail line owners who are concerned with the safety and conditions of the track. Thus the maximum quantity of product that a shipper may place in a railcar will be affected by the weight of the carbody, its contents, and the trucks. Hence any weight reduction that may be made in the truck components will be available to increase the carrying capacity of the car. Weight reduction of the bolsters has heretofore been disfavored and regarded as particularly difficult as the bolster flexes when supporting the carbody between the two side frames and is known to therefore be subject to fatigue brought about by load cycling.

SUMMARY OF THE INVENTION

Accordingly, it is an object of the present invention to reduce the weight of a railcar truck bolster.

It is another object of the present invention to reduce stress concentration at critical areas of a railcar truck bolster.

Briefly stated the present invention primarily involves the reduction of metal in the top member and the elimination of openings in the bottom member so as to both reduce overall weight and lower the neutral axis to thereby reduce stress in the bottom wall. The thickness of the bottom member may also be reduced. Internal risers are also located directly at bend points in the bottom member to assure optimum distribution of unflawed cast metal at those areas of predicted stress concentration.

BRIEF DESCRIPTION OF THE DRAWINGS

Other objects and advantages of the present invention will become apparent from the following detailed descriptions taken in conjunction with the drawings wherein.

DETAILED DESCRIPTION OF THE INVENTION

Figure 1:
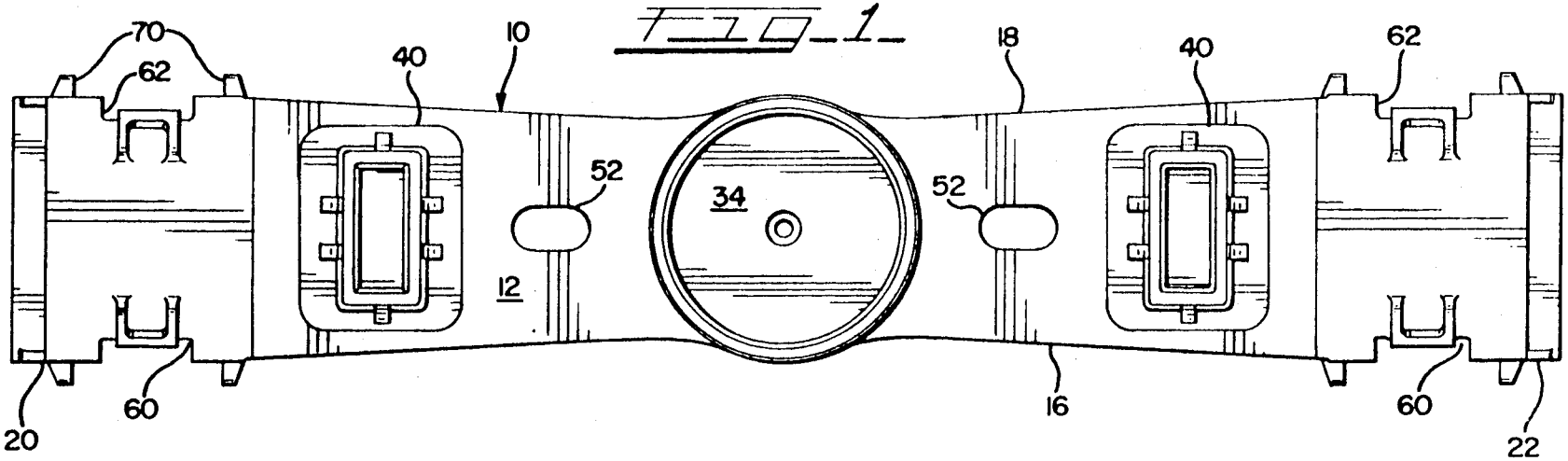
FIG. 1 is a top plan view of a bolster according to the present invention.
Figure 2:
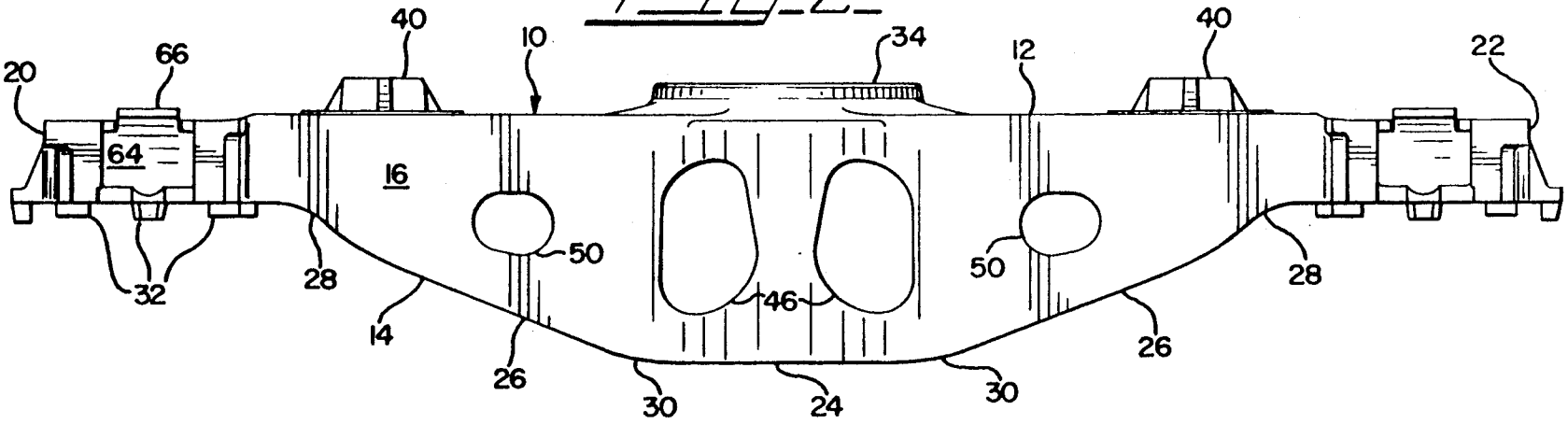
FIG. 2 is a side elevation view of the bolster of FIG. 1.
Figure 3:
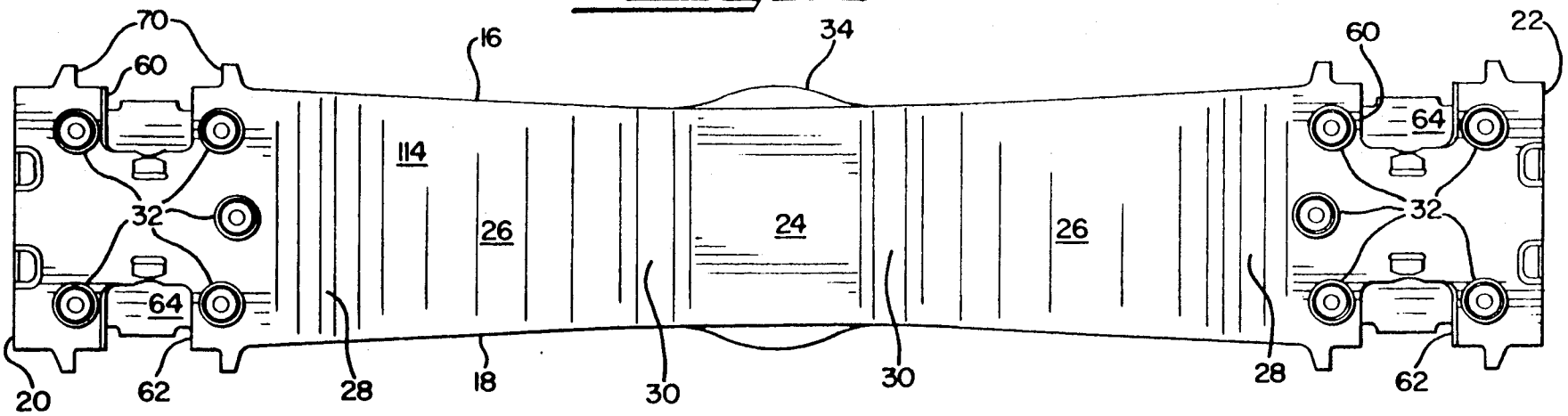
FIG. 3 is a bottom plan view of the bolster of FIG. 1.
Figure 4:
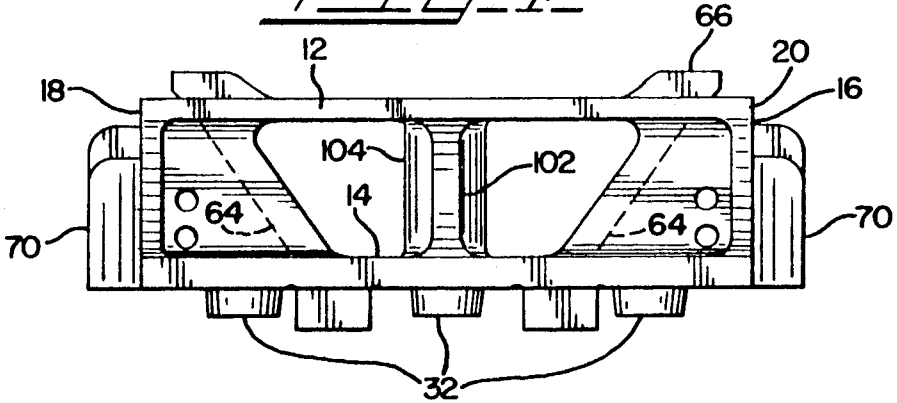
FIG. 4 is an end view of the bolster of FIG. 1.

FIGS. 1-3, while specifically illustrating a preferred form of a cast steel railcar truck bolster according to the present invention, are also generally illustrative of typical prior art bolster construction. That is to say the over all exterior shape and dimensions are substantially the same, and it will be understood that a bolster generally 10 includes a top member 12 (also known as a compression member), a bottom member 14 (also known as a tension member) and two exterior side walls 16, 18 all of which extend the full length of the bolster between open ends 20, 22. It is to be noted that the bolster 10 has a greater vertical dimension at a central area and the bottom member 14 includes a horizontal central portion 24 with diagonal panels 26 at each side angling upwardly to horizontal areas at each end 20, 22 and create upper and lower bend points 28, 30 at the junctures with the end and center horizontal portions, respectively. Typically a truck bolster 10 is mounted transversely between two side frames to form a railcar truck (not shown) which rides on wheels and axles and is located beneath one end of a railcar body. The bolster ends 20, 22 extend through windows in the respective side frames and rest on spring groups that are contained by the side frames. Hence, as may be seen in FIGS. 2 and 3 the bolster bottom member 14 has a plurality of integrally cast spring seat bosses 32 on a horizontal portion adjacent each end 20, 22 which serve to interposition the bolster 10 on the respective spring groups; and the bolster top member 12 has integrally cast thereon, a single centrally located bearing bowl 34 and a pair of side bearing mounts 40 which serve to support and stabilize the car body.

Also typical of bolster construction are a pair of brake rod openings 46 in each side wall 16, 18 beneath the bearing bowl 34 and lightener holes 50, 52 in the side walls 16, 18 and top member 12, respectively. As is well understood the brake rod openings 46 may be provided for accessory brake equipment (not shown) which may extend through and to each side of the bolster 10; and lightener holes 50, 52 are provided to reduce the quantity and weight of metal in the bolster construction. (Prior art bolsters also normally include core positioning holes in the bolster bottom wall; however, it is important that such holes not occur in the bolster bottom wall 14 of the present invention.) In the manufacturing process the brake rod openings and lightener holes, as well as core positioning holes, also serve to facilitate positioning of sand cores within molding flasks prior to pouring molten metal and for subsequently removing the same after the cast metal cools.

It may also be noted in FIGS. 1 and 2 that typical bolster construction includes pairs of friction shoe pockets 60, 62 above the spring seat bosses 32 near each end 20, 22. Each pocket 60, 62 extends inwardly of a side wall 16, 18, respectively, and includes an enclosure with a sloped surface 64 that extends to a lip 66 upward of the top wall 12. The pockets 60, 62 serve to locate and contain friction shoes (not shown) which are biased against vertical columns in the side frames to dampen vertical oscillation of the bolster 10. Bolsters also typically include gibs 70, cast on the side walls 16, 18 both inboard and outboard of each pocket 60, 62, which serve to properly locate the bolster ends within the side frame windows.

Figure 5:
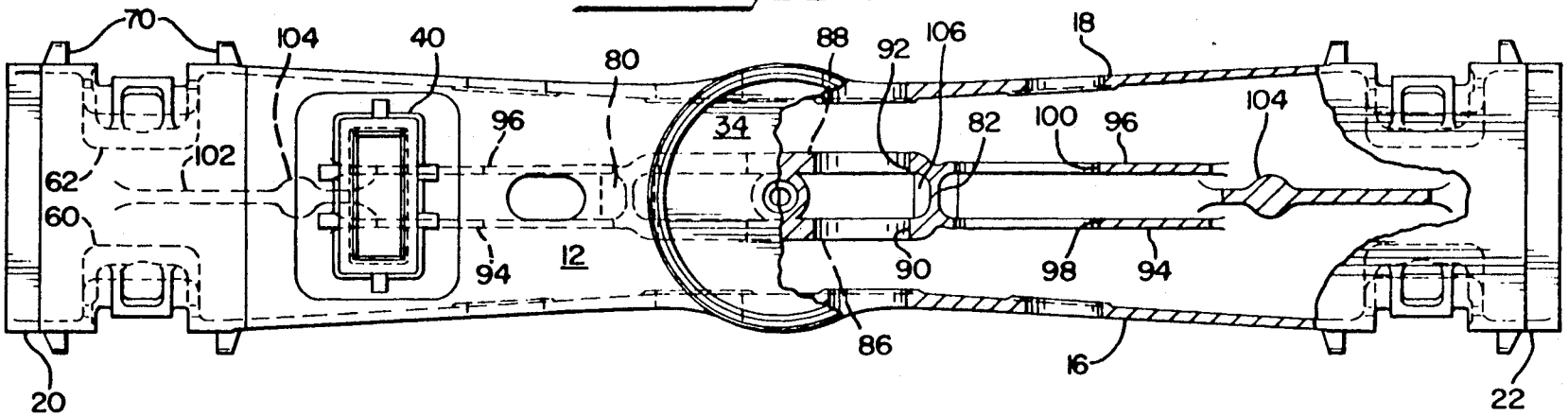
FIG. 5 is a top plan view similar to FIG. 1 in partial section showing internal structure of the bolster.
Figure 6:
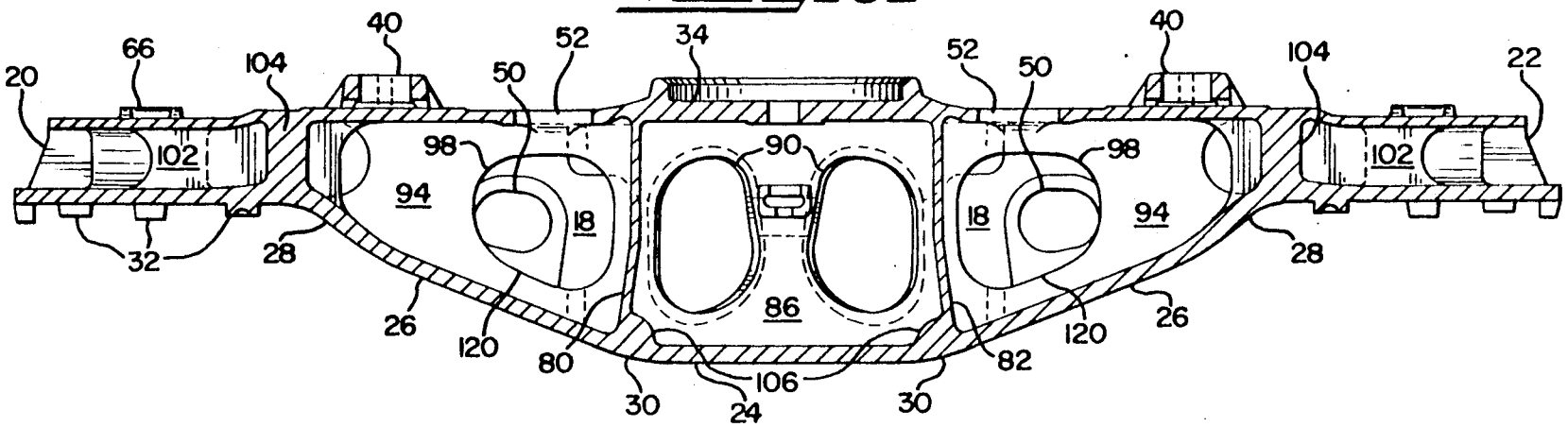
FIG. 6 is a sectional elevation view similar to FIG. 2 showing internal structure of the bolster.

Internally of the bolster side walls 16, 18 it is also normal to include a pair of central transverse ribs 80, 82 (best seen in FIGS. 5 and 6) extending vertically between the top and bottom members 12, 14 just outwardly of the bearing bowl 34 and between a pair of closely spaced center ribs 86, 88 that parallel the side walls 16, 18. The center ribs 86, 88 also contain brake rod openings 90, 92 that are aligned with and conform to the openings 46 in side walls 16, 18. As may also be seen in FIGS. 5 and 6 a pair of side bearing ribs 94, 96 extend outward from each transverse rib 80, 82, substantially aligned with the center ribs 86, 88, to points beneath the side bearing mounts 40; and from those points outward toward the pockets 60, 62 at each bolster end 20, 22 extend single imperforate center end ribs 102. Each of the side bearing ribs 94, 96 contains a lightener hole 98, 100, respectively, aligned with but larger than the lightener holes 50 in side walls 16, 18. It is to be noted that all of the aforementioned interior ribs 80, 82, 86, 88, 94, 96 and 102 extend the full vertical distance between the top and bottom members 12 and 14 to strengthen the bolster 10 against shear forces.

It is known that the principal potential cause of failure in a bolster is metal fatigue caused by tension induced stress largely concentrated in the bottom member 14 and to a lesser degree extending into the immediately adjacent portions of the side walls 16, 18 and internal center ribs 86, 88, side bearing ribs 94, 96 and center end ribs 102. Stress tends to concentrate at openings in those members and at any anomalies in the cast metal such as casting flaws, abrupt bends (such as bend points 28, 30) or offsets and even mold or core sand pits in the cast surfaces. Another source of stress concentration is the retention of chaplets in the cast metal. (Chaplets are metal spacers that accurately position the core parts within mold flasks so as to properly space the core and mold surfaces to give the desired metal thicknesses in the resultant castings; and the chaplets ideally melt and become indistinguishable from the cast metal. At least two physical forms of chaplets are known; namely a stem type comprising a single rod between two spaced plates and a perforated type comprising essentially a small cage or section of perforated metal with two open opposing sides. The latter is preferred in the present invention.) Stress is also known to increase directly in relation to distance from a neutral axis, the latter by definition being the locus of points where the moment of metal above that point is equal to (balanced by) the moment of metal below that point. Generally speaking the neutral axis for a bolster is spaced above and parallel to the bolster bottom member 14.

The bolster top member 12 is subjected to compressive stress which must be accommodated but is a less significant problem due to the inherent characteristics of metal fatigue.

Heretofore design considerations to withstand both compression and tension induced stress have largely involved increasing the thickness of the top and bottom members 12 and 14 without regard to bolster weight. However, in modern railcar design truck bolster weight is receiving increased attention due to efforts to maximize the carrying capacity of the car.

According to the present invention the bolster weight may be reduced by employing the following design techniques.

The distance between the bolster bottom wall 14 and the neutral axis is decreased to thereby lessen the tension stress concentration in the bottom member. This is accomplished largely by reducing the average thickness of primarily the top member 12 and also the diagonal panels 26 of the bottom member 14 while eliminating all lightener holes therein.

Stress concentration in the bottom member 14 is also reduced by (1) the elimination of any holes therein, (2) by providing internal risers 104, 106 (channels and reservoirs for molten metal to flow during casting) central to the upper bend points 28 and lower bend points 30 in the bottom member 14 and (3) the center end ribs 100 are also extended outwardly to at least the mid-points of pockets 60, 62.

The weight of metal may be further reduced by thinning the internal ribs including the transverse ribs 80, 82, center ribs 86, 88, side bearings ribs 94, 96 and center end ribs.

Stress concentration is further reduced in the lower portions of the side bearing ribs 94, 96 by increasing the distance between the bottom member 14 and the lower edges 120 of lightener holes 98, 100 in ribs 94, 96 and smoothing the curvature of the lower edges 120 by employing compound radii at the outward corners of the holes.

As an example, a light weight bolster designed according to the present invention for 100 ton trucks reduced the bolster weight to 1290 lbs. from 1472 lbs. for the prior standard comparable bolster of normal configuration and exterior dimensions. This was accomplished largely by reducing the top member 12 nominal thickness from $\frac{7}{8}$ inch (0.875 inch) to $\frac{5}{8}$ inch (0.625 inch) and reducing the thickness of the bottom member 14 diagonal panels 26 from 15/16 inch (0.938 inch) to $\frac{7}{8}$ inch (0.875 inch) and eliminating all holes therein. The foregoing were the main contributing factors in moving the neutral axis downward along the length of the bottom member 14. For instance in the light weight bolster of this invention, the neutral points above the upper bend points 28 is 2.3426 inches above the outer surface of bottom member 14 which constitutes a lowering of 0.3914 inch from the corresponding neutral point in a comparable prior art bolster (it is to be understood that the actual distance varies across the length of the bolster).

Additionally the bottom edge 120 of each of the lightener holes 98, 100 in side bearing ribs 94, 96 was moved upward from 1 inch to a minimum of $1\frac{5}{8}$ inch (1.625 inch) above the inner surface of the panel 26; and the outer corners of the holes were changed from a 4 inch radius to a compound curve struck from radii of 6 inch and $2\frac{1}{2}$ inch (as the curves swing outward of the bolster center).

As previously mentioned internal risers 104, 106 of approximately 3 inch diameter were also provided directly at the bottom member 14 bend points 28, 30 where there is stress concentration and where thickened sections of metal are designed in the bottom member. And the center end ribs 102 were lengthened to extend to the friction shoe pocket mid points.

The foregoing changes and the use of the best available core making practices including robotic sand compaction also enabled more precise control of wall thickness and thereby allowed some reduction in thickness of vertical walls. For instance in the thinnest portions of the side walls 16, 18 and internal ribs thicknesses were reduced by about $\frac{1}{8}$ inch (0.125 inch). It is to be understood that, as in typical bolster design, the actual cross sectional dimensions of the various internal and external walls vary somewhat throughout the length of the bolster.

The foregoing details have been provided to describe a best mode of the invention and further variations and modifications may be made without departing from the spirit and scope of the invention which is defined in the following claims.

What is claimed is:

1. An improved cast steel railcar truck bolster of relatively light weight construction, said bolster comprising:

a top member and side walls having lightener holes therein;

a bottom member of continuous metal without any opening therein, said bottom member including two diagonal panels of a given thickness interconnected at lower bend points by a central portion of relatively greater thickness, said diagonal panels connected at upper bend points to outwardly extending bolster ends; and an internal riser at each of said upper and lower bend points, said internal risers connected to said bottom member.

2. The improved bolster of claim 1 wherein said top and bottom members are of thicknesses less than $\frac{7}{8}$ inch and 15/16 inch, respectively, and the relative amounts of metal in said top and bottom members locates a neutral axis at about 2.34 inches above an outer surface of said member.

3. The improved bolster of claim 2 wherein said neutral axis being above the upper bend points.

4. The improved bolster of claim 2 wherein a nominal top member thickness is about $\frac{5}{8}$ inch, a thickness of said bottom member diagonal panels is about $\frac{7}{8}$ inch and a thickness of said central portion of the bottom member is about 1 inch.

5. The improved bolster of claim 1 including internal ribs extending between said top and said bottom members, said internal ribs having second lightener openings generally aligned with said lightener openings in said side walls, each of said second lightener openings being defined by an edge formed of compound radii curves and having a bottom edge portion that is a distance of at least about $1\frac{5}{8}$ inches above said bottom member.

* * * * *

UNITED STATES PATENT AND TRADEMARK OFFICE

CERTIFICATE OF CORRECTION

PATENT NO. : 5,111,753

DATED : May 12, 1992

INVENTOR(S) : Herbert L. Zigler, Robert D. Wronkiewicz
Franklin S. McKeown Jr., William A. Wachter

It is certified that error appears in the above-identified patent and that said Letters Patent is hereby corrected as shown below:

Column 6:
In Claim 2, last line, insert --bottom-- before "member"

Signed and Sealed this

Sixth Day of July, 1993

*Attest:*

Michael K. Kirk

MICHAEL K. KIRK

*Attesting Officer*

*Acting Commissioner of Patents and Trademarks*